US005769746A

United States Patent [19]

Siegel

[11] Patent Number: 5,769,746

[45] Date of Patent: Jun. 23, 1998

[54] TENNIS RACKET WITH STRATEGIC PLAY VALUE

[76] Inventor: William B. Siegel, 186 W. Montauk Hwy., Hampton Bays, N.Y. 11946

[21] Appl. No.: 839,374

[22] Filed: Apr. 18, 1997

[51] Int. Cl.[6] ..... A63B 49/10

[52] U.S. Cl. ..... 473/524

[58] Field of Search ..... 473/524, 535, 473/536, 547, DIG. 14

[56] References Cited

U.S. PATENT DOCUMENTS

| | | | |
|---|---|---|---|
| D. 260,671 | 9/1981 | Law | 473/524 |
| 293,573 | 2/1884 | Greenough et al. | 473/524 |
| 881,266 | 3/1908 | Thompson | 473/524 |
| 2,293,312 | 8/1942 | Sewell | 273/DIG. 14 |
| 4,212,693 | 7/1980 | Saito et al. | 273/DIG. 14 |

*Primary Examiner*—William E. Stoll
*Attorney, Agent, or Firm*—Myron Amer PC

[57] ABSTRACT

As a substitute from opaque plastic of choice for the construction material of a tennis racket, use instead is made of a clear plastic that viewed from afar, such as from one base line to the other, prevents the opponent of the user of the clear plastic racket from visibly detecting a racket position as might enable the opponent to anticipate the shot to be executed by the user, to thereby contribute to the strategic playing value of the tennis racket.

1 Claim, 1 Drawing Sheet

FIG. 1
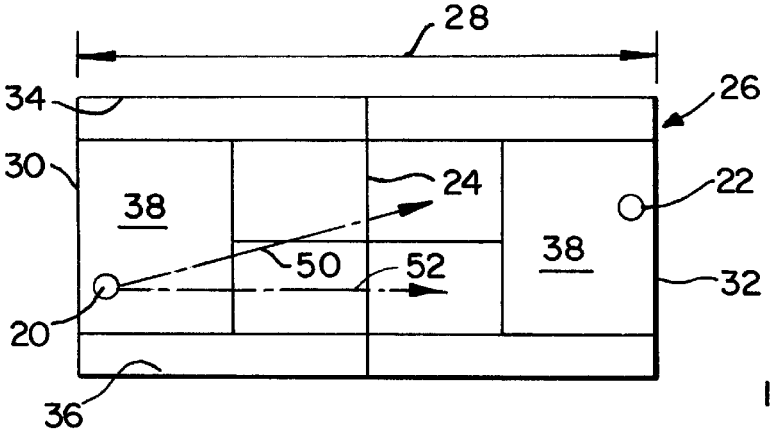
FIG. 2
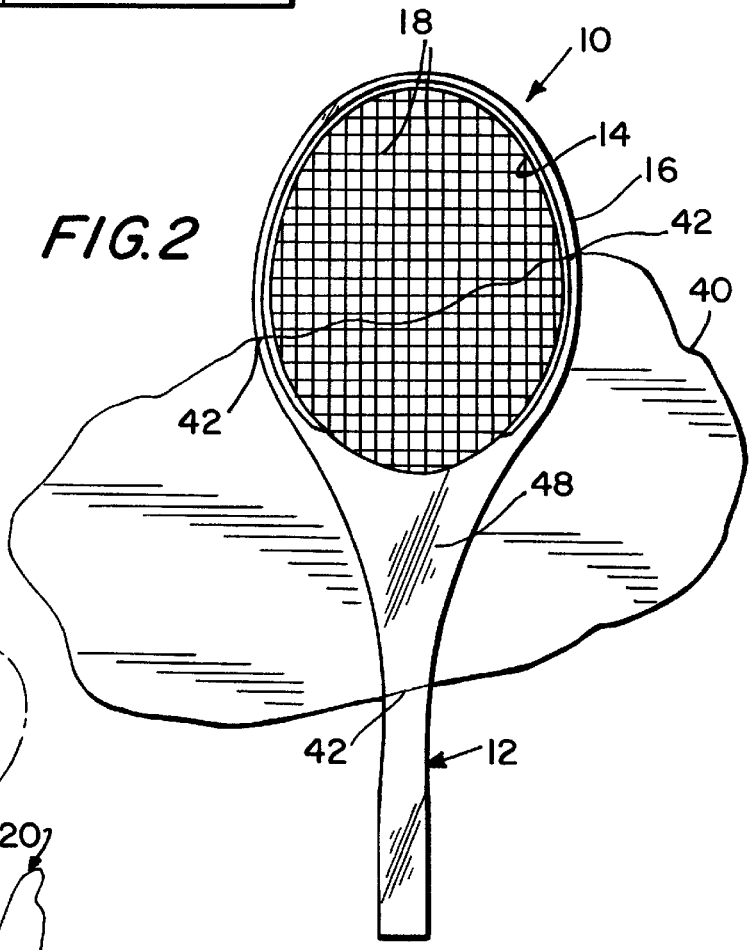
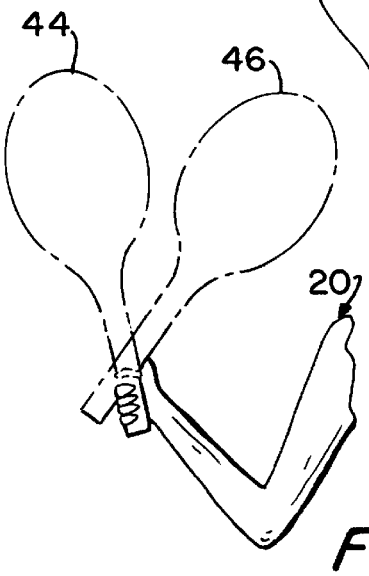
FIG. 3

TENNIS RACKET WITH STRATEGIC PLAY VALUE

The present invention relates generally to improvements for a tennis racket, the improvements more particularly contributing to competitive play value of the racket.

It is already well known that embodying in a tennis racket an enlarged ball-striking area, a better balance, or so-called "feel", to mention but a few physical attributes, enhances the playing ability of the user. These embodied physical attributes while useful, are limited in the extent that they contribute to the competitive play value of the racket, by which is meant having a direct effect on the successful outcome of the tennis match in which the tennis racket is used.

Broadly, it is an object of the present invention to provide a significantly enhanced outcome-effecting tennis racket overcoming the foregoing and other shortcomings of the prior art.

More particularly, it is an object in addition to improving the playing of the user of the within inventive racket, to also curtail playing strategies of his/her opponent to better assure a successful outcome of the tennis match for said user, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a diagrammatic illustration of a tennis court;

FIG. 2 is an elevational view of the within inventive tennis racket; and

FIG. 3 is a partial illustration of a user of the tennis racket during play as seen by an opponent.

The within inventive tennis racket 10 has a gripping handle 12, an oval shaped opening 14 bounded by a frame 16 integral to the handle 12, and a criss-crossing arrangement of strings 18 supported from the frame 16 in spanning relation across the opening 14 which, in the playing of tennis is used by opponents 20 and 22 on opposite sides of a net 24 of a regulation-sized tennis court 26, one pertinent dimension 28 to note is 78 feet between opposite base lines 30 and 32 which, with the side lines 34 and 36 delineate the playing area 38. Typically in play, the players 20 and 22 simultaneously occupy the playing positions illustrated adjacent the base lines 30, 32.

The construction material of choice of the tennis racket 10 is plastic which, according to the present invention is characterized by being clear, by which is meant that any background object 40 is visible, as denoted at 42, through the tennis racket 10.

As a consequence, assuming the players 20 and 22 are at the playing positions adjacent the opposite base lines 30 and 32, as may best be understood from FIG. 3, a user 20 of the tennis racket 10 might have one of the racket positions 44 or 46, it being understood by common experience respectively being suitable either for a cross court or a down-the-line shot, but at the distance 28 these racket positions 44, 46 are not visibly detectable by the opponent 22, due to the clear plastic construction material 48 of the tennis racket 10, and thus a detected racket position 44, 46 cannot be factored into a playing strategy of the opponent, i.e. the opponent 22 in anticipation of the shot of the user 20 is not able to know to move left or right to be in position to return a cross court 50 or a down-the-line 52 shot.

A selection by a person well versed in the chemical arts of one from many commercially available plastics for the construction of the tennis racket 10 having the noted characterizing feature 48 is switched from opaque to clear thermoplastic materials including polyamides, polycarbonate, acrylonitrile-butadiene-styrene (ABS), acetal resins and poly (phenylkene oxide) (PPO) of U.S. Pat. No. 4,440,392. Other switched from opaque to clear plastic construction materials suitable for the tennis racket 10 are the plastics of U.S. Pat. No. 5,551,689, No. 5,516,100 and No. 3,998,457.

The construction material of the strings 18 is optionally clear plastic or, in tennis parlance, clear "gut".

While the tennis racket herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A tennis racket of a type used by opponents on opposite sides of a net of a tennis court measuring 78 feet between opposite base lines thereof, said tennis racket being further of a type having a gripping handle, an opening-bounding frame integral to said gripping handle, and a crossing arrangement of strings supported from said frame in said opening, said tennis racket characterized by a clear plastic construction of said handle and said frame, whereby in simultaneously occupied playing positions at said base lines a position of said racket by a user is not visibly detectable by an opponent so as to be factored into a playing strategy of said opponent.

* * * * *